US009108455B2

(12) United States Patent
Hecker

(10) Patent No.: US 9,108,455 B2
(45) Date of Patent: Aug. 18, 2015

(54) PENCIL

(75) Inventor: Dieter Hecker, Nuremberg (DE)

(73) Assignee: STABILO International GmbH, Heroldsberg (DE)

( * ) Notice: Subject to any disclaimer, the term of this patent is extended or adjusted under 35 U.S.C. 154(b) by 613 days.

(21) Appl. No.: 13/318,194

(22) PCT Filed: Apr. 21, 2010

(86) PCT No.: PCT/EP2010/002453
§ 371 (c)(1),
(2), (4) Date: Oct. 31, 2011

(87) PCT Pub. No.: WO2010/127768
PCT Pub. Date: Nov. 11, 2010

(65) Prior Publication Data

US 2012/0051827 A1 Mar. 1, 2012

(30) Foreign Application Priority Data

May 4, 2009 (DE) ..... 20 2009 006 484

(51) Int. Cl.
*A46B 5/02* (2006.01)
*B43K 23/008* (2006.01)

(52) U.S. Cl.
CPC ..... *B43K 23/008* (2013.01)

(58) Field of Classification Search
CPC ..... B43K 19/00; B43K 23/008; A45D 40/20
USPC ..... 401/6, 88; 16/430; D19/47–50
See application file for complete search history.

(56) References Cited

U.S. PATENT DOCUMENTS

| | | | | |
|---|---|---|---|---|
| 2,826,175 | A | 3/1958 | O'Connell | |
| 2,988,784 | A * | 6/1961 | Lorenian | 401/88 |
| 4,526,547 | A | 7/1985 | Rusk | |
| 5,338,201 | A * | 8/1994 | Levine | 434/178 |
| 8,291,785 | B2 | 10/2012 | Shige et al. | |
| 8,434,954 | B2 * | 5/2013 | Gitman et al. | 401/6 |
| 8,549,712 | B2 * | 10/2013 | Cornfield | 16/430 |
| 8,770,880 | B2 * | 7/2014 | Hecker | 401/6 |
| 2010/0316428 | A1 | 12/2010 | Hillemann | |

FOREIGN PATENT DOCUMENTS

| | | | |
|---|---|---|---|
| CN | 2752066 | Y | 1/2006 |
| DE | 3427324 | A1 | 2/1985 |
| DE | 202008002102 | U1 | 6/2008 |
| EP | 0710575 | A1 | 5/1996 |
| GB | 2271738 | A | 4/1994 |

(Continued)

OTHER PUBLICATIONS

Stabilo International GMBH, Isometric view of pencil at 30 degrees, Feb. 27, 2015.*

(Continued)

*Primary Examiner* — Jennifer C Chiang
(74) *Attorney, Agent, or Firm* — Bachman & LaPointe, PC

(57) ABSTRACT

A pencil having a longitudinal axis and a gripping recess, in which the inside contour of the gripping recess in a first sectional plane transversely to the longitudinal axis has at least one concave portion. The inside contour of the gripping recess in a second sectional plane intersecting the first sectional plane at the longitudinal axis has at least one convex portion.

7 Claims, 3 Drawing Sheets

(56) References Cited

FOREIGN PATENT DOCUMENTS

| | | | |
|---|---|---|---|
| JP | 50-144736 | U | 11/1975 |
| JP | 5710869 | Y2 | 3/1982 |
| JP | 2004-175041 | A | 6/2004 |
| JP | 2009156279 | A | 7/2009 |

OTHER PUBLICATIONS

Stabilo International GMBH, Isometric view of pencil at 90 degree, Feb. 27, 2015.*

* cited by examiner

PENCIL

BACKGROUND OF THE INVENTION

The invention concerns a pencil having a longitudinal axis and a gripping recess, in which the inside contour of the gripping recess in a first sectional plane transversely to the longitudinal axis has at least one concave portion.

Pencils of the above-indicated kind are known, for example from German utility model no. 20 2008 002 102. In the known pencils the gripping recesses are provided for example with a spherical milled head so that they are of a part-spherical configuration. In other words the inside contour of the gripping recesses in the known pencils are concave not only in the above-mentioned first sectional plane transversely to the longitudinal axis but also in a second sectional plane intersecting the first sectional plane at the longitudinal axis. When using cylindrical milling cutters the known pencils each have a gripping recess with an inside contour which has a concave portion in a first sectional plane transversely relative to the longitudinal axis while they have a flat portion in a second sectional plane intersecting the first sectional plane at the longitudinal axis.

Introducing a gripping recess in a pencil results in a weakening effect for the pencil because the pencil is reduced in diameter in the region of the gripping recess. That weakening effect is on the one hand detrimental to stability of the pencil and on the other hand detrimental to holding/the holding feel of the pencil.

The object of the invention is to develop the pencil of the kind set forth in the opening part of this specification in such a way that stability and/or the hold/holding feel of the pencil is/are improved.

SUMMARY OF THE INVENTION

According to the invention in the pencil of the kind set forth in the opening part of this specification that object is attained in that the inside contour of the gripping recess in a second sectional plane intersecting the first sectional plane at the longitudinal axis has at least one convex portion.

In other words in accordance with the invention the gripping recess is of a configuration in the manner of a saddle, thereby at least in part compensating for weakening of the pencil as a consequence of producing the gripping recess. Therefore the stability and/or hold/holding feel of the pencil is/are improved. The convex portion can extend over the entire inside contour of the gripping recess in the sectional plane in question.

According to the invention the second sectional plane is preferably perpendicular to the first sectional plane. That has advantages in terms of forming the gripping recess by means of cutting tools.

When reference is made hereinbefore to the fact that the first sectional plane in which the inside contour of the gripping recess has at least one concave portion is disposed transversely relative to the longitudinal axis, that does not mean just a sectional plane that is perpendicular to the longitudinal axis. Rather the term "transversely" stands for all ergonomically appropriate orientations.

For ergonomic optimization in accordance with the invention however the first sectional plane preferably includes an angle of $25° \leq \alpha \leq 35°$, preferably $27° \leq \alpha \leq 33°$, further preferably $29° \leq \alpha \leq 31°$, with the longitudinal axis. The orientation of the angle $\alpha$ depends on whether this is a pencil for right-handed or for left-handed people.

To further improve the ergonomy aspect the convex portion can be at least portion-wise of an arcuate configuration, preferably a circular arcuate configuration.

Finally according to the invention it is further preferred that the inside contour of the gripping recess has a convex portion in a sectional plane disposed perpendicularly to the longitudinal axis. That portion can also again extend over the entire inside contour of the gripping recess.

BRIEF DESCRIPTION OF THE DRAWINGS

The invention is described more fully hereinafter by means of preferred embodiments by way of example with reference to the accompanying drawing in which.

DETAILED DESCRIPTION

Figure 1:
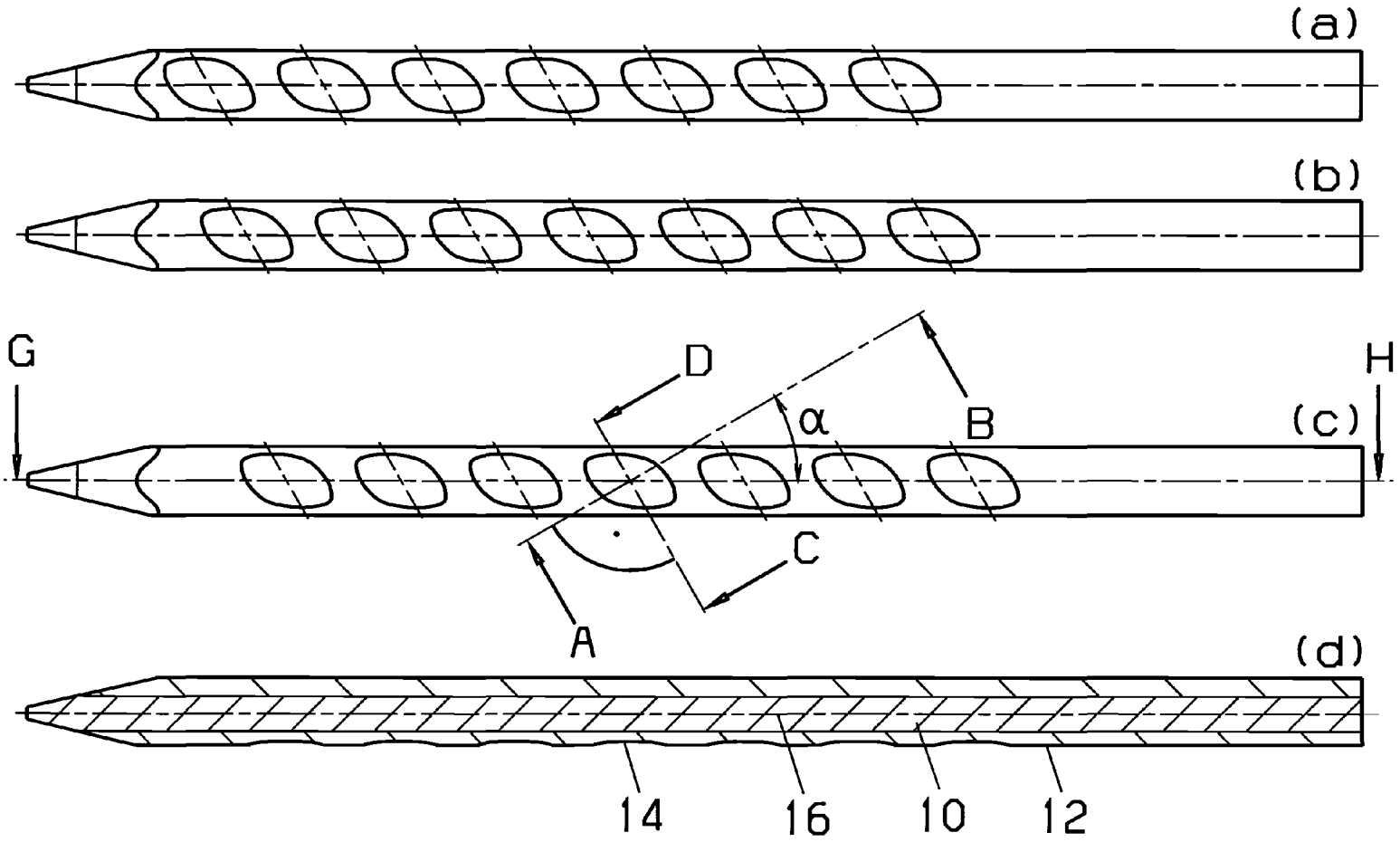
FIGS. 1(*a*) through (*c*) show views each turned through 60° relative to each other of a pencil for right-handed people in accordance with an embodiment of the invention, FIG. 1(*d*) shows a sectional view along line G-H in FIG. 1(*c*)
Figure 3:
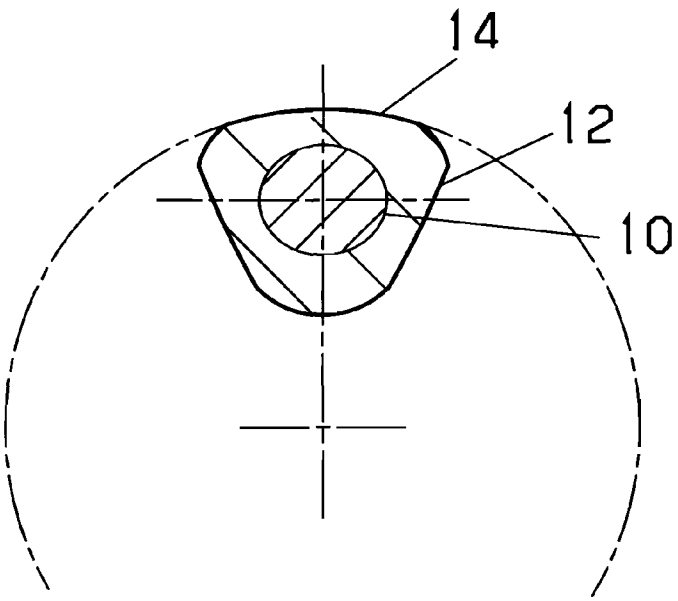
FIG. 3 shows a sectional view on an enlarged scale along line C-D in FIG. 1(*c*), FIGS. 4(*a*) through (*c*) show the same views as FIGS. 1(*a*) through (*c*) but of an embodiment for left-handed people, FIG. 5(*a*) shows a perspective view of the pencil of FIGS. 1 through 3 (right-handed people), and FIG. 5(*b*) shows a perspective view of the pencil of FIG. 4 (left-handed people).
Figure 2:
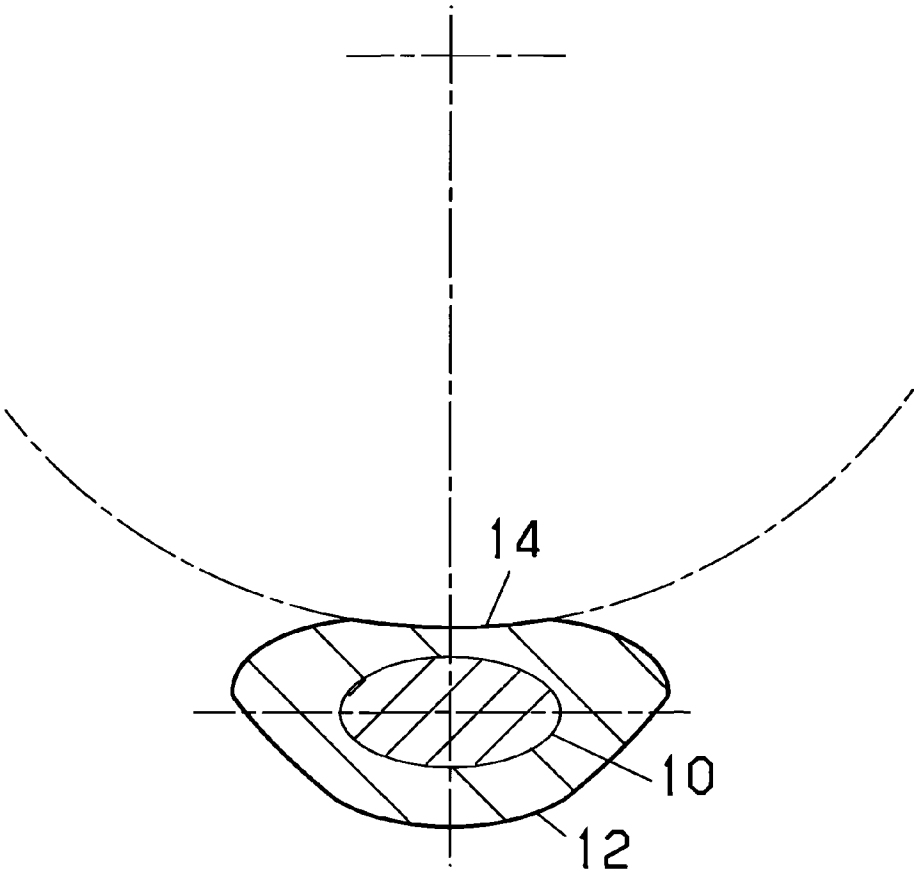
FIG. 2 shows a sectional view on an enlarged scale along line A-B in FIG. 1(*c*)
Figure 4:
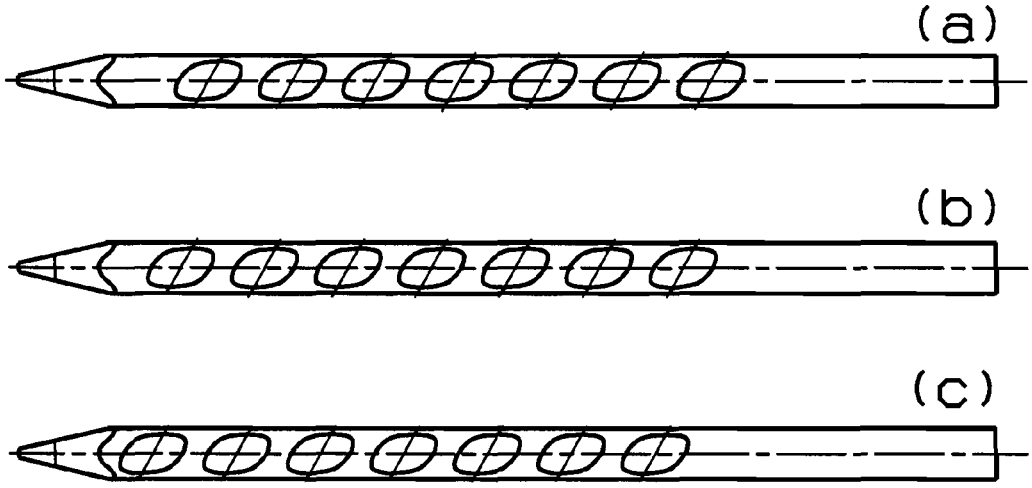
Figure 5:
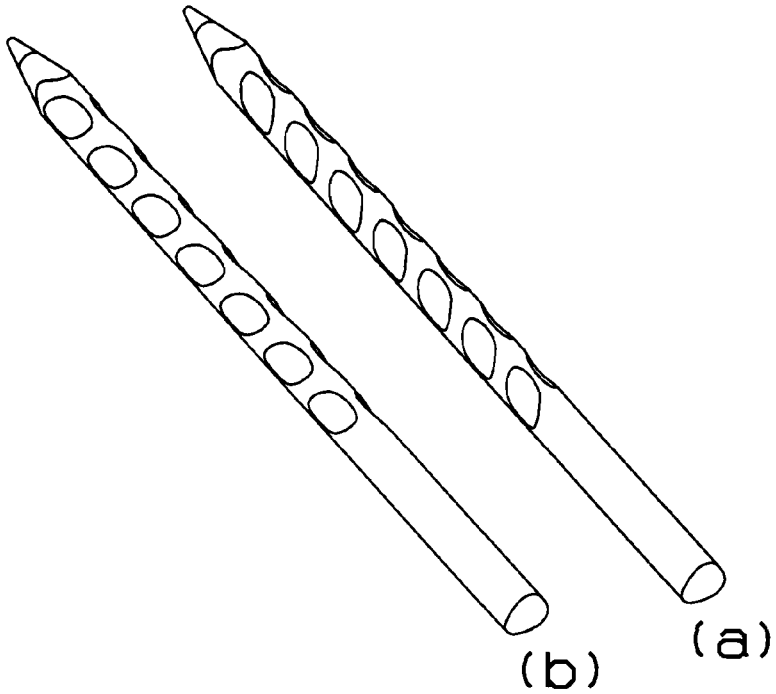

The pencil shown in FIGS. 1 through 3 has a lead 10 and a lead case 12. Provided in the lead case 12 are numerous gripping recesses of which one is denoted by way of example with reference numeral 14.

The view in FIG. 2 is a sectional view, the sectional plane including an angle $\alpha$ of 30° with a longitudinal axis 16 of the pencil. The sectional plane in the view in FIG. 3 is perpendicular to that in FIG. 2.

As shown in FIG. 2 the gripping recess 14, in the view shown in FIG. 2, onto the first sectional plane, has a concave inside contour. In particular it is in the shape of a circular arc. The inside contour of the gripping recess 14 as shown in FIG. 3 is in comparison convex in the view onto the second sectional plane which is perpendicularly to the first sectional plane. It will be noted however that it is also in the shape of a circular arc in this embodiment.

Although this is not illustrated in the drawing the inside contour of the gripping recess 14 has a convex portion, in a sectional plane that is perpendicular to the longitudinal axis 16.

The configuration set forth in detail hereinbefore of the gripping recess 14 and possibly also the other gripping recess minimizes the weakening of the pencil, that is linked to the formation of the gripping recesses. In addition the hold/holding feel of the pencil is improved over a conventional pencil with a gripping recess.

The features of the invention disclosed in the foregoing description, the claims and the drawing can be essential both individually and also in any combinations for carrying the invention into effect in its various embodiments.

The invention claimed is:

1. A pencil comprising a longitudinal axis (16) and a gripping recess (14) having an inside contour, wherein the inside contour of the gripping recess in a first sectional plane transversely to the longitudinal axis has at least one concave portion, and wherein the inside contour of the gripping recess in a second sectional plane intersecting the first sectional plane at the longitudinal axis has at least one convex portion.

2. A pencil as set forth in claim 1, wherein the second sectional plane is perpendicular to the first sectional plane.

3. A pencil as set forth in claim 1 or claim 2, wherein the first sectional plane includes with the longitudinal axis an angle $\alpha$ where $25° \leq \alpha \leq 35°$.

4. A pencil as set forth in claim 1 or claim 2, wherein the first sectional plane includes with the longitudinal axis an angle $\alpha$ where $27° \leq \alpha \leq 33°$.

5. A pencil as set forth in claim 1 or claim 2, wherein the first sectional plane includes with the longitudinal axis an angle $\alpha$ where $29° \leq \alpha \leq 31°$.

6. A pencil as set forth in claim 2, wherein the convex portion is at least portion-wise of an arcuate configuration in the form of a circular arc.

7. A pencil as set forth in claim 2, wherein the inside contour of the gripping recess (14) has a convex portion in a sectional plane that is perpendicular to the longitudinal axis (16).

* * * * *